United States Patent [19]

Quilling et al.

[11] Patent Number: 4,660,226

[45] Date of Patent: Apr. 28, 1987

[54] BIB

[75] Inventors: Marlys M. Quilling, 3428 Dale St., Eau Claire, Wis. 54703; Sherrie M. Edwards, Eau Claire, Wis.; Jeanette M. Mathews, 821 Lynn Ste., Chippewa Falls, Wis. 54729

[73] Assignees: Marlys M. Quilling, Eau Claire; Jeanette M. Mathews, Chippewa Falls, both of WI

[21] Appl. No.: 850,984

[22] Filed: Apr. 11, 1986

[51] Int. Cl.[4] ..... A41B 13/10

[52] U.S. Cl. ..... 2/49 R

[58] Field of Search ..... 2/48, 49 A, 49 R

[56] References Cited

U.S. PATENT DOCUMENTS

| | | | |
|---|---|---|---|
| 2,244,656 | 6/1941 | Asch | 2/49 R |
| 2,424,680 | 7/1947 | Doyle | 2/49 R |
| 2,803,574 | 8/1957 | Payant | 2/49 R |
| 3,001,646 | 9/1961 | Cooper | 2/49 R |
| 3,146,464 | 9/1964 | Burnett | 2/49 R |
| 3,328,807 | 7/1967 | Strauss | 2/49 R |
| 3,329,969 | 7/1967 | Farber et al. | 2/49 R |
| 3,416,157 | 12/1968 | Marder et al. | 2/49 R |
| 3,488,773 | 1/1970 | Stemmer | 2/49 R |
| 3,871,027 | 3/1975 | Orr | 2/49 R |
| 3,995,321 | 12/1976 | Johnson | 2/49 R |
| 3,999,221 | 12/1976 | Hannigan | 2/49 R |
| 4,038,697 | 8/1977 | Levitt | 2/49 R |
| 4,261,057 | 4/1981 | Anderson | 2/49 R |
| 4,441,212 | 4/1984 | Ahr et al. | 2/49 R |

*Primary Examiner*—Doris L. Troutman

*Attorney, Agent, or Firm*—Kinney & Lange

[57] ABSTRACT

A bib 10 comprising a rectangular pad 12 and first and second extensions 34 and 36 is disclosed. The bib 10 includes a first absorbent layer 22 and the second waterproof layer 24 with adhesive strips 62 and 64 provided on the waterproof layer 24. A pocket 50 is provided at the bottom of the bib, and is constructed to normally remain "open" during use. The bib can be creased along crease lines 66 and 68 for storage; areas of silicone 70 may be applied to allow the adhesive to be removed from a folded position. The leg-like extensions 34 and 36 allow the bib 10 to be closely fitted around the neck of any wearer.

20 Claims, 11 Drawing Figures

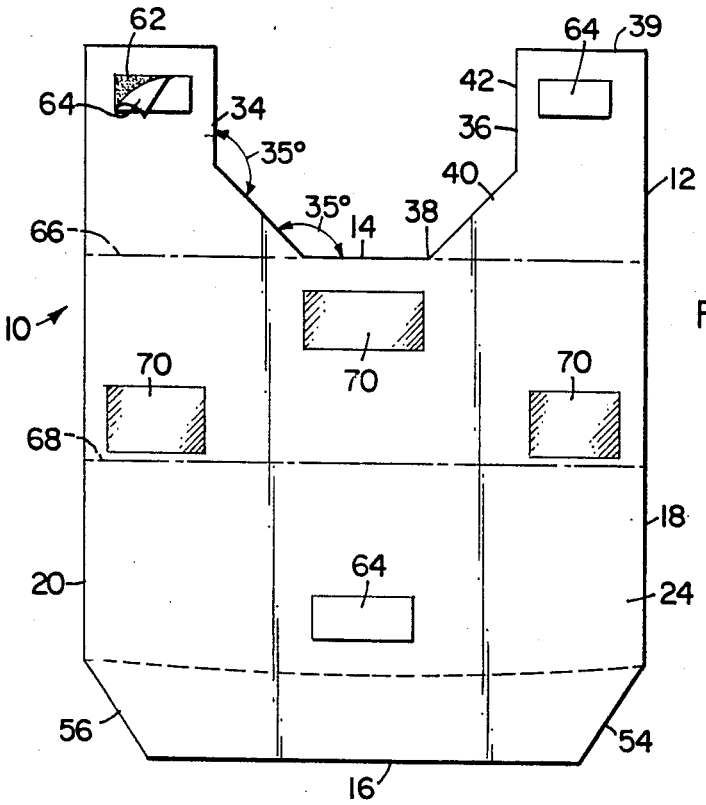
FIG. 4
FIG. 5
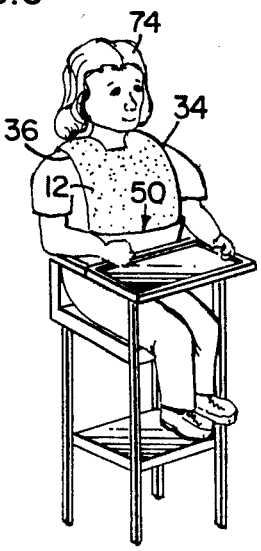
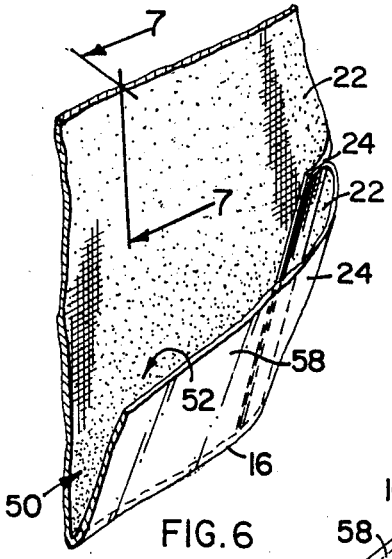
FIG. 6
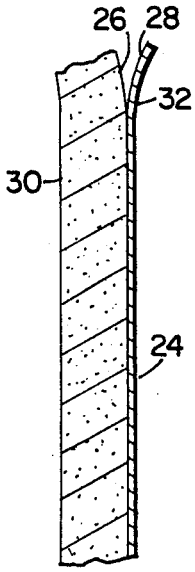
FIG. 7
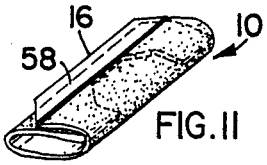
FIG. 11

BIB

TECHNICAL FIELD

The present invention pertains to the field of protective coverings for clothing and more particularly to the field of disposable bibs.

BACKGROUND OF THE INVENTION

Disposable bibs for babies, and even adults, are known. However, prior art bibs generally have a circular neckline so their effective use is limited to a person with a certain neck size. If one of these circular neckline bibs is worn by a person with a different size neck than the neckline mandates, the bib will either not lie flat on the front of the wearer or the bib will not fit snugly around the wearer's neck.

Many prior art bibs also have pockets on the bottom to catch crumbs that fall while the wearer eats. To be effective, these pockets must be open; the disadvantage with these prior art pockets lies in their limited effectiveness. Known bib pockets fall into three general categories: pockets that do not stay open, pockets that stay open only because they are affixed to a distant object and pockets that stay open because of an elaborate and complex construction.

An understanding of certain of the prior art devices will make apparent the improvement of the present invention. The Asch U.S. Pat. No. 2,244,656 discloses a child's bib having a U-shaped neckline and a separate tape or string useful for affixing the bib to the wearer. The Doyle U.S. Pat. No. 2,424,680 discloses a continuous roll-type paper bib, having a semicircular cutout.

The Payant U.S. Pat. No. 2,803,574 discloses a napkin having a diamond-shaped adhesive element affixed to one side near a corner. A release agent is applied to a portion of an adjacent corner of the napkin. The Cooper U.S. Pat. No. 3,001,646 shows another continuous roll-type bib having a crumb-catching trough and a circular neck opening. A cohesive material is applied to portions of the bib. The Burnett U.S. Pat. No. 3,146,464 shows a continuous bib having a fold-up crumb-catching trough, a circular neck opening with patches of self-adhering adhesive near the neck, and tie strips to encircle the waist or upper body of the wearer.

The Straus U.S. Pat. No. 3,328,807 discloses a disposable bib, again having a fold-up crumb-catching trough and a circular neck opening with a self-sealing adhesive useful to attach the bib to the wearer.

The Farber et al. U.S. Pat. No. 3,329,969 discloses a disposable flexible, absorbent material. The Marder et al. U.S. Pat. No. 3,416,157 discloses a disposable bib having alternatively a U-shaped or circular neckline. A crumb-catching trough is also disclosed.

The Stemmer U.S. Pat. No. 3,488,773 discloses a dental towel having three adhesive patches affixed to the backside thereof, for attaching the dental towel to the wearer. The Orr U.S. Pat. No. 3,871,027 discloses a combination burp pad and bib having a semicircular neckline, and a plurality of self-adhering tabs.

The Johnson U.S. Pat. No. 3,995,321 discloses a disposable bib which includes a circular neckline, an absorbent cloth, and a crumb-catching trough which is affixed with adhesive strips to a table or other distant object.

The Hannigan U.S. Pat. No. 3,999,221 discloses a disposable bib having a one-piece construction and including elongated tie strips formed as a part of the bib construction. The Levitt U.S. Pat. No. 4,038,697 discloses a combination bed sheet and disposable smock or bib. The Ahr et al. U.S. Pat. No. 4,441,212 discloses a bib having a funnel-shaped neckline and adhesive strips for forming a crumb-catching trough and affixing the bib to the wearer.

SUMMARY OF THE INVENTION

The invention is a disposable bib having a substantially rectangular pad or body portion of two layers bonded together. The first layer is absorbent and the second layer is waterproof. The bib includes a means for snuggly fitting the bib around any size neck.

A pocket is located at the bottom of the body or pad, and the bib may be attached to the wearer with one or more pressure-sensitive adhesive strips which may themselves be covered with protective strips to prevent unwanted adhesion. In one version of the invention, the pocket is formed with a notch on each side to create a bib which has a self-opening pocket.

BRIEF DESCRIPTION OF THE DRAWINGS

FIG. 4 is a back plan view of the embodiment shown in FIG. 1;

FIG. 5 is a perspective schematic view of the present invention being worn by a child;

FIG. 6 is a fragmentary perspective view of the lower corner portion of the embodiment shown in FIG. 1;

FIG. 7 is a partial cross-sectional view taken generally along line 7—7 in FIG. 6;

FIG. 11 is a perspective view of the invention of FIG. 1 folded and shown on a reduced scale.

DETAILED DESCRIPTION OF THE PREFERRED EMBODIMENT

Throughout the following description reference will be made to the drawings. Identical numerals will be used throughout the several views to indicate the same or like parts of the invention. The structure and use of the invention will be discussed.

Figure 1:
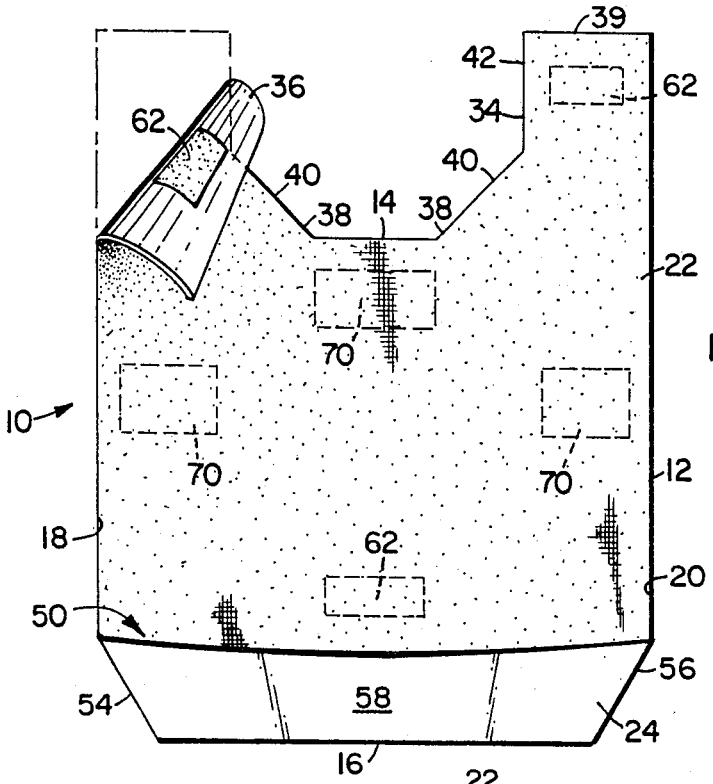
FIG. 1 is a front plan view of the present invention with a portion curled to show the backside thereof.

Referring now to FIG. 1, the preferred embodiment of the present invention is shown. A disposable bib 10 including a substantially rectangular pad 12 with a top end 14 and a bottom end 16 is presented. The rectangular pad 12 also includes sides 18 and 20, respectively, which define the width of the pad 12. The pad 12 has a first or absorbent layer 22 bonded with adhesive to a second or waterproof layer 24. The absorbent layer may be spongy and soft, making it ideal for wiping and comfortable for wearing. Each layer has an inside surface 26 and 28, respectively, and an outside surface 30 and 32, respectively. (See FIG. 7.)

The bib 10 includes a means for snuggly fitting the bib around any size neck. The means for snuggly fitting includes two leg-like extensions 34 and 36, respectively. The extensions 34 and 36 are configured to define a bib neckline. The extensions are adjacent the top end 14 of the pad 12. Each extension has a base 38 continuous with the top 14 of the pad 12, and defining the bottom of a lower portion 40 of each extension. The width of said bottom of said lower portion is approximately two-fifths of the width of the pad. The lower portion 40 of each leg-like extension narrows gradually at an angle between 30 and 60 degrees, and preferably 45 degrees from the base portion 38 toward the unattached end 39 of the leg-like extension.

The gradual narrowing of the lower portion of each leg-like extension ends approximately one half the distance from the base 38 to the unattached end 39 of the leg-like extension. From this point on toward the unattached end, the width of the leg-like extension is constant and equal to the narrowest width of the gradually narrowing lower portion 40. This width is approximately one-half the width of the base or lower portion of the leg-like extension.

Like the rectangular pad 12, the leg-like extensions 34 and 36 have a first or absorbent layer 22 bonded to a second or waterproof layer 24, each layer having an inside 26 and 28, respectively, and an outside 30 and 32, respectively. (See FIG. 7.)

As can perhaps best be seen in FIGS. 1 and 6, the bib 10 further includes a pocket 50 having an interior 52 and first and second pocket ends 54 and 56. The pocket 50 is located at the bottom end 16 of the pad 12. The pocket 50 is formed by folding a portion of the pad 12 over on itself with the absorbent layer 22 forming the interior of the pocket 50. The pocket ends 54 and 56, respectively, are secured to each other to form a crumb-catching trough or pocket. As will be described below, the construction of the pocket of the preferred embodiment creates a pocket which is generally open and far more effective than many types of superficially similar devices.

Figure 2:
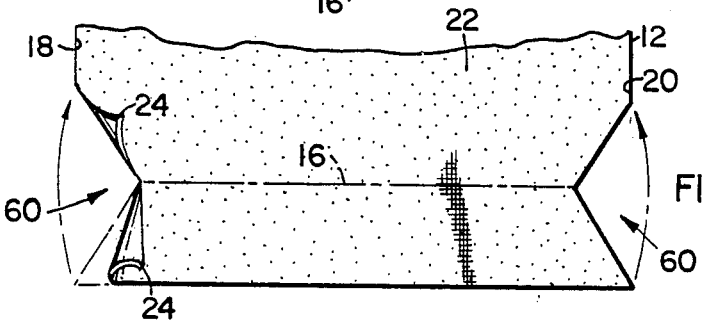
FIG. 2 is a partial plan view of the embodiment shown in FIG. 1 with the crumb-catching trough unfolded.
Figure 3:
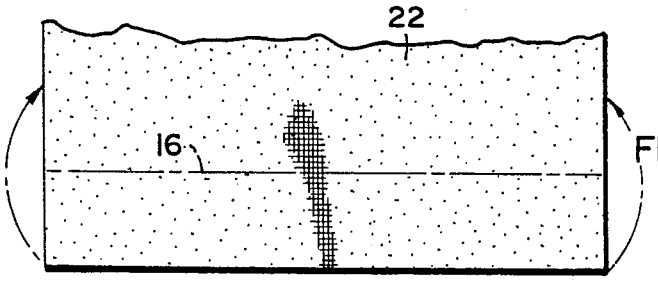
FIG. 3 is again a partial plan view of the bottom portion of a second embodiment of the present invention.

As can be seen in FIG. 2, a notch 60 is provided on each side 18 and 20 at the bottom 16 of the pad 12. The pocket ends 54 and 56 are secured with the second or waterproof layer 24 in face-to-face relation. (See also FIG. 6.) This unique construction biases the pocket 50 in an open position. The resiliency of the bilayer material allows the pocket lip 58 to lie spaced from the remainder of the bottom end 16 of the pad 12. This result is accomplished without the need for affixing the pocket to a distant object or with a complicated structure.

This construction can be achieved by folding waterproof portion of the pocket in fact to fact relation with the back side of the bib, glueing the pocket ends 54 and 56 and turning the pocket 50 inside out so that the absorbent portions of the pocket are face to face. This technique will curl the pocket ends and help maintain the pocket in an "open" position.

The bib 10 also includes a means for removably attaching the bib to the wearer 74. The attachment means includes at least one pressure-sensitive adhesive strip 62 affixed to the first and second extensions 34 and 36, respectively, on the outside surface 32 of the waterproof second layer 24. Another similar adhesive strip 62 is positioned near the bottom end 16 of the bib. A protective strip 64 covers each adhesive strip 62 prior to attachment of the bib 10 to the wearer 74. One or more of the protective strips 64 are removed to expose the adhesive 62, (See FIG. 4) prior to application to the wearer.

The bib 10 also includes a means for folding the bib for storage. The folding means includes an upper crease line 66 and a lower crease line 68 formed within the pad 12. The crease lines 66 and 68 are generally parallel to the ends 14 and 16 of the bib 10 and run perpendicular to the sides 18 and 20 of the pad 12. The crease lines allow the bib 10 to be folded generally in thirds. The upper crease line 66 is adjacent to the top end 14 of the pad 12, and the lower crease line 68 is adjacent and above the pocket 50 of the bib.

Areas or patches of silicone 70 are positioned on the outside surface 32 of the waterproof layer 24 of the pad 12 in locations corresponding to the position of the adhesive strips 62 when the extensions 34 and 36, and the lower portion of the pad 12 are folded along the crease lines 66 and 68. When the protective strips 64 are removed from the adhesive strip 62, and the bib is folded along the crease lines, the silicone 70 contacts the adhesive strips and allows the bib to be unfolded for re-use as the silicone 70 will allow the adhesive 62 to be released from the waterproof layer 24. It is advisable to fold the upper portion of the bib along the upper crease line 66 before folding the lower portion along the lower crease line 68 so that the silicone patches 70 near the sides of the bib are not covered by the lower portion of the bib.

In reference now generally to FIGS. 8 through 10, the neckline design of the bib 10 will be described in more detail. As can be seen also in FIGS. 1 and 4, the neckline approximates 5/8ths of a regular octagon. The neckline includes five line segments, evenly numbered 80 through 88 inclusive. The first line segment 80 runs generally parallel to the first side 18 of the pad 12, for a distance equal to approximately one half the length of the first extension 34. The second neck segment 82 lies at an angle with respect to the first neck segment 80 of approximately 135° when the bib is lying in a single plane. The second neck segment 82 extends downwardly to the top end 14 of the pad 12, where it meets one end of the third line segment 84, again at an included angle of approximately 135°. The third line segment 84 runs generally parallel to the bottom edge of the bib. The fourth and fifth neck segments 86 and 88, respectively, lie in like relation along the second extension 36.

The neck segments 80 through 88 allow the bib 10 to be comfortably yet snuggly worn by any person regardless of the size of their neck. The included angles between the neck segments allow the leg-like extensions 34 and 36 to be positioned on the wearer for a snug fit which does not present gaps through which food or liquids can pass, yet does not bind or chafe around the neck 72 of the wearer 74. The angles between the line segment can be varied while affixing the bib about the neck and shoulders of the wearer while maintaining the main body of the pad in a flat smooth layer over the wearer.

As the bib is draped over the shoulders of the wearer 72, the included angles between the line segments 80–88 are varied to allow the bib to assume the compound shape of the wearer. The included angles can be increased or decreased about the three dimensions (horizontal, vertical and lateral) to comfortably fit the neck 72 of the wearer 74 while placing the main body of the bib flat against the body of the wearer 74 in a way which is not possible with typical bibs.

Figure 8:
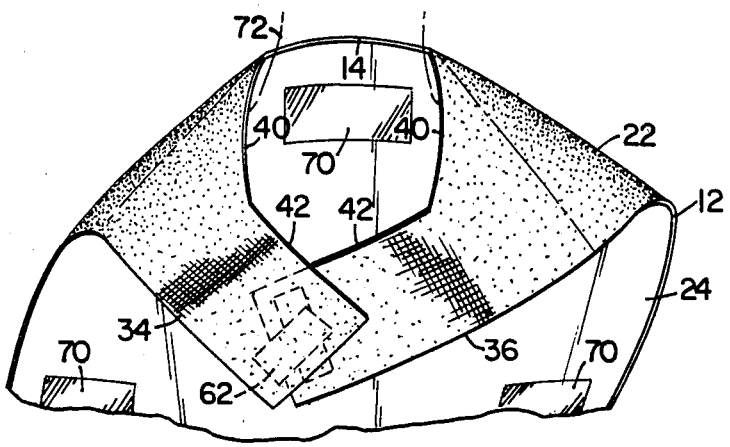
FIG. 8 is a partial perspective view of the upper portion of the embodiment shown in FIG. 1 as worn by a small person.
Figure 9:
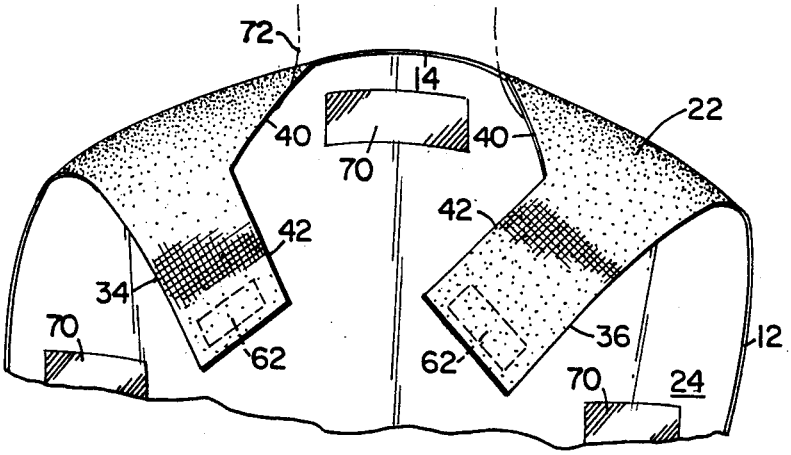
FIG. 9 is a partial perspective view of the embodiment shown in FIG. 1 as worn by a medium-size person.
Figure 10:
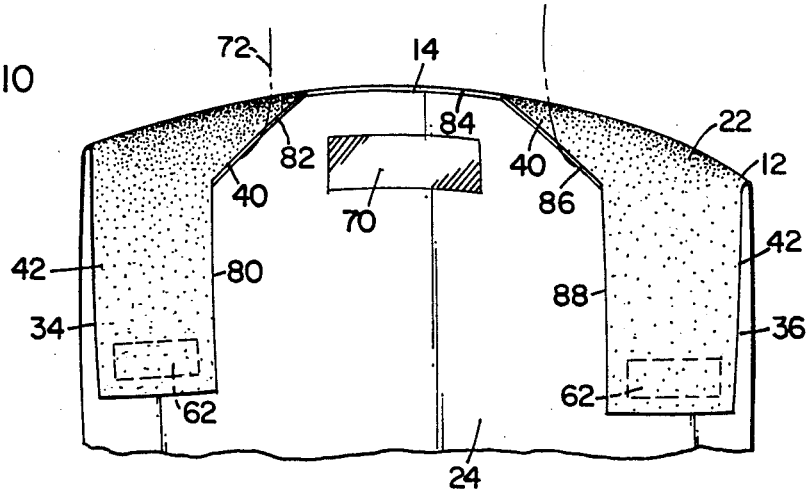
FIG. 10 is a partial perspective view of the embodiment shown in FIG. 1 as worn by a large person.

As can be seen from FIGS. 8 through 10, the leg-like extensions 34 and 36 can be attached together to snuggly fit around a child or infant. (See FIG. 8.) The leg-like extensions can be spaced apart yet angled toward each other for applying the bib to a medium-size person. (See FIG. 9.) Further, for a large person, the leg-like extensions can be placed somewhat parallel to each other (see FIG. 10) or angled away from each other as necessary to snuggly fit the bib to the wearer. As described above the included angles between the line segments 80 through 88 can be varied in three dimensions as the extensions are fitted to the wearer.

METHOD OF USE

The structure described above can be advantageously used as will now be described. The bib 10 would normally be folded during transportation or storage before use. The protective coverings or strips 64 are affixed over the adhesive strips 62. The bib is first folded along the crease lines so that the first and second extensions 34 and 36 are folded along crease line 66 and rest against the mid-portion of the rectangular pad 12. The bottom portion of the rectangular pad 12 is then folded along crease line 68 to lie over the leg-like extensions and rest against the extensions and a portion of the mid part of the rectangular pad 12. (See FIG. 11.)

The bib can then be unfolded, (by lifting the bottom portion, and then lifting the extensions) the pocket 50 can then be adjusted to ensure that it will remain open during use and to overcome any flattening which may have occurred during shipment or storage. (As described above, the pocket 50 should naturally remain open due to its construction.) The adhesive strips can then be exposed by removing therefrom the protective coverings or strips 64. The bib can then be applied to the wearer and the leg-like extensions 34 and 36 can be positioned around the shoulders and neck of the wearer to provide a snug yet comfortable and leak-free fit. This can be accomplished by positioning leg-like extensions and varying (in three dimensions) the included angles between the line segments 80 through 88 inclusively.

After use, the bib can be folded for storage by folding the leg-like extensions 34 and 36 along crease line 66 and positioning the adhesive strip 62 in contacting relation with the areas of silicone 70 on the mid-portion of the rectangular pad 12. The bottom portion of the bib can then be folded along crease line 68 with the lowermost adhesive portion 62 positioned in contacting relation to the area of silicone 70 centrally located just below the neckline of the bib. The bib can then be unfolded for later use and application to the wearer as described above.

Certain materials are believed to be particularly well suited for use in constructing the invention. Plastic sheeting is suitable for the waterproof layer, while quality paper stock such as product number 207-402 available from the Central Wisconsin Paper Company is suitable for the absorbent layer. Any spongy, absorbent cloth or paper would normally be suitable. The absorbent and waterproof layers can be adhered together with adhesives such as rubber cement or the aerosol spray adhesives commonly used to mount photographs. Those skilled in the art would recognize a wide range of suitable alternative materials including composite materials having an absorbent side and a waterproof side.

In light of the above teachings, it will be appreciated that several variations of the disclosed preferred embodiment are possible. A number of characteristics and advantages of the invention have been set forth together with the structure and method of use of the preferred embodiment. The novel features thereof are pointed out in the following claims. The above disclosure is merely illustrative, changes may be made in detail with respect to size, shape, and structural arrangement. The principles of the invention should not be limited to the abovedescribed embodiment. The extent of the invention is defined by the general meaning of the terms set forth in the claims.

What is claimed is:

1. A disposable bib, comprising:

a substantially rectangular pad having top and bottom ends, sides and a width, said pad having a first and a second layer bonded together, said first layer being absorbent and said second layer being waterproof, each layer having an inside and an outside surface; and a means for snugly fitting said bib around any size neck, said means including two leg-like extensions configured to define a neckline adjacent said top end of said pad, said extensions each having a base of width less than one-half of said pad width, a lower portion adjacent said top of said pad wherein said width narrows gradually, and an upper portion wherein the width is constant and equal to the narrowest width of said lower portion, said extensions having a first and a second layer bonded together, said first layer being absorbent and said second layer being waterproof, each layer having an inside and an outside surface.

2. The bib of claim 1 further including a pocket having an interior and pocket ends, said pocket located at said bottom end of said pad, said pocket formed by folding a portion of said pad over on itself with said absorbent layer forming said interior of said pocket and said pocket ends being secured together.

3. The bib of claim 2 further including a notch on each of said sides at said bottom of said pad, and said pocket ends being secured with said waterproof layers face-to-face.

4. The bib of claim 1, further including a means for removably attaching said bib to the wearer, said means including at least one pressure sensitive adhesive strip affixed to each of said extensions on said outside surface of said waterproof layer thereof.

5. The bib of claim 4, further including a protective strip covering each said adhesive strip, each protective strip being separable from its adhesive strip to expose the adhesive material for attachment to the wearer.

6. The bib of claim 1, further including a means for folding said bib for storage, said means including an upper and a lower crease line in said pad, parallel to said ends, said upper crease line adjacent said top end of said pad and said lower crease line above said pocket but below the middle of said pad.

7. The bib of claim 6, further including areas of silicone positioned on said outside surface of said waterproof layer of said pad and located thereon to contact said adhesive strips when said extensions and said lower portion of said pad are folded on said crease lines.

8. A disposable bib, comprising:

a substantially rectangular pad having top and bottom ends, sides and a width, said pad having a first and a second layer bonded together, said first layer being absorbent and said second layer being waterproof, each layer having an inside and an outside surface;

a means for snugly fitting said bib around any size neck, said means including two leg-like extensions configured to define a neckline adjacent said top end of said pad, said extensions each having a width of approximately two-fifths of said width of said pad, a lower portion wherein said width narrows gradually at an angle between 30 to 60 degrees with respect to the vertical and then stops narrowing at a point half-way up said extension; and an upper portion wherein the width is constant and equal to approximately one-half of said width of said base of said extension, said extensions having a first and a second layer bonded together, said first layer being absorbent and said second layer being waterproof, each layer having an inside and an outside surface.

9. The bib of claim 8, wherein said width of said extension narrows gradually at an angle of 45 degrees with respect to the vertical.

10. The bib of claim 8, further including a pocket having an interior and pocket ends, said pocket located at said bottom end of said pad, said pocket formed by folding a portion of said pad over on itself with said absorbent layer forming said interior of said pocket and said pocket ends being secured together.

11. The bib of claim 10, further including a notch on each of said sides at said bottom of said pad, and said pocket ends being secured with said waterproof layers face-to-face.

12. The bib of claim 8, further including a means for removably attaching said bib to the wearer, said means including at least one pressure sensitive adhesive strip affixed to said extensions on said outside surface of said waterproof layer.

13. The bib of claim 12, further including a protective strip covering each adhesive strip, each protective strip being separable from its adhesive strip to expose the adhesive material for attachment to the wearer.

14. The bib of claim 8, further including a means for folding said bib for storage, said means including an upper and a lower crease line in said pad, parallel to said ends, said upper crease line adjacent said top end of said pad arc said lower crease line above said pocket but below the middle of said pad.

15. The bib of claim 14, further including areas of silicone positioned on said outside surface of said waterproof layer of said pad and located thereon to contact said adhesive strips when said extensions and said lower portion of said pad are folded on said crease lines.

16. A disposable bib, comprising:

a substantially rectangular pad having top and bottom ends, sides and a width, said pad having a first and a second layer bonded together, said first layer being absorbent and said second layer being waterproof, each layer having an inside and an outside surface;

a means for snugly fitting said bib around any size neck, said means including two leg-like extensions configured to define a neckline adjacent said top end of said pad, said extensions each having a base of width less than one-half of said pad width, a lower portion adjacent said top of said pad wherein said width narrows gradually, and an upper portion wherein the width is constant and equal to the narrowest width of said lower portion, said extensions having a first and a second layer bonded together, said first layer being absorbent and said second layer being waterproof, each layer having an inside and an outside surface;

a notch on each of said sides at said bottom of said pad; and a pocket having an interior and pocket ends, said pocket formed by folding a portion of said pad over on itself with said absorbent layer forming said interior of said pocket and said pocket ends being secured with said waterproof layers face-to-face.

17. The bib of claim 16, further including a means for removably attaching said bib to the wearer, said means including at least one pressure sensitive adhesive strip affixed to each of said extensions on said outside surface of said waterproof layer thereof.

18. The bib of claim 17, further including a protective strip covering each adhesive strip, each protective strip being separable from its adhesive strip to expose the adhesive material for attachment to the wearer.

19. The bib of claim 16, further including a means for folding said bib for storage, said means including an upper and a lower crease line in said pad, parallel to said ends, where said upper crease line is adjacent said top end of said pad and said bottom crease line is above said pocket but below the middle of said pad.

20. The bib of claim 19, further including areas of silicone positioned on said outside surface of said waterproof layer of said pad and located thereon to contact said adhesive strips when said extensions and said lower portion of said pad are folded on said crease lines.

* * * * *

UNITED STATES PATENT AND TRADEMARK OFFICE

CERTIFICATE OF CORRECTION

PATENT NO. : 4,660,226

DATED : April 28, 1987

INVENTOR(S) : Marlys M. Quilling et al.

It is certified that error appears in the above-identified patent and that said Letters Patent is hereby corrected as shown below:

Column 7, line 46, "arc" should read -- and --.

Signed and Sealed this

Eighteenth Day of August, 1987

*Attest:*

DONALD J. QUIGG

*Attesting Officer*

*Commissioner of Patents and Trademarks*